US009601883B1

(12) United States Patent
Chung et al.

(10) Patent No.: US 9,601,883 B1
(45) Date of Patent: Mar. 21, 2017

(54) USB CONNECTOR

(71) Applicant: KUANG YING COMPUTER EQUIPMENT CO., LTD., New Taipei (TW)

(72) Inventors: Hsuan-Ho Chung, New Taipei (TW); Yu-Hung Lin, New Taipei (TW)

(73) Assignee: KUANG YING COMPUTER EQUIPMENT CO., LTD., New Taipei (TW)

( * ) Notice: Subject to any disclaimer, the term of this patent is extended or adjusted under 35 U.S.C. 154(b) by 0 days.

(21) Appl. No.: 14/932,992

(22) Filed: Nov. 5, 2015

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 23/02; H01R 24/60; H01R 24/62
USPC ..... 439/660, 108
See application file for complete search history.

(56) References Cited

U.S. PATENT DOCUMENTS 4,582,386 A * 4/1986 Martens ..... H01R 12/727 439/101
8,662,936 B2 * 3/2014 Chung ..... H01R 13/6471 439/607.35
8,827,750 B2 * 9/2014 Chung ..... H01R 13/6461 439/660
8,864,529 B2 * 10/2014 Chung ..... H01R 13/6471 439/660

* cited by examiner

*Primary Examiner* — Phuong Dinh
(74) *Attorney, Agent, or Firm* — Leong C. Lei

(57) ABSTRACT

A USB Type-C connector includes a transmission conductor group arranged according to functions and positions associated with electric characteristics. The transmission conductor group includes a first signal transmission conductor group, a second signal transmission conductor group, and a power transmission conductor group. Considering the way of arrangement, the second signal transmission conductor group is located at one side of the first signal transmission conductor group and the power transmission conductor group is similarly located at one side of the first signal transmission conductor group. As such, with such an arrangement, advantages of improved interference resistance, bettered performance of high frequency, and large electric current can be achieved.

17 Claims, 10 Drawing Sheets

USB CONNECTOR

TECHNICAL FIELD OF THE INVENTION

The present invention relates generally to an electric connector, and more particularly to a USB Type-C connector that offers advantages of interference resistance, bettered high frequency performance, and large electric current.

DESCRIPTION OF THE PRIOR ART

Electric connectors have their own evolution of technology. For example, the early version USB connector, which is commonly referred to as USB2.0, has evolved to the later version of USB3.0 that has a must faster operation speed and then further evolved toward the Type-C version that is even faster than the 3.0 version and allows for plugging at both sides. Such a history of evolution is definitely remarkable and impressed.

The USB Type-C connector, although having a faster speed and allowing for double-side plugging so as to ease the uses thereof by users, suffers a severe problem in high frequency operations. The unsolved high frequency issue generally leads to problems of signal transmission and severe interference.

SUMMARY OF THE INVENTION

An object of the present invention is that by providing an arrangement of a first signal transmission conductor group, a second signal transmission conductor group, and a power transmission conductor group according to functions and positions associated with electric characteristics, advantages of improved interference resistance, bettered performance of high frequency, and large electric current can be achieved.

A structure that the present invention adopts to achieve the above object comprises a first signal transmission conductor group for transmission of signals and a second signal transmission conductor group or the power transmission conductor group arranged at one side of the first signal transmission conductor group. The power transmission conductor group comprises two adjacent power differential signal transmission conductors and power transmission conductors respectively arranged at an outer side of each of the power differential signal transmission conductors. The power transmission conductors have a volume width that is greater than a volume width of the power differential signal transmission conductors so as to obtain an advantage of large electric current. Further, considering the structure, the first signal transmission conductor group has an end defining a first signal transmission adaptation section group and the second signal transmission conductor group has an end defining a second signal transmission adaptation section group that is arranged at a side of the first signal transmission adaptation section group. The power transmission conductor group has an end defining a power adaptation section group that is arranged at a side of the first signal transmission adaptation section group or the second signal transmission adaptation section group. As such, with such an arrangement, advantages of interference resistance and bettered performance of high frequency can be achieved.

With the above techniques, the severe high frequency interference issue of the conventional electrical connector can be overcome so as to achieve the practical utilization of the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
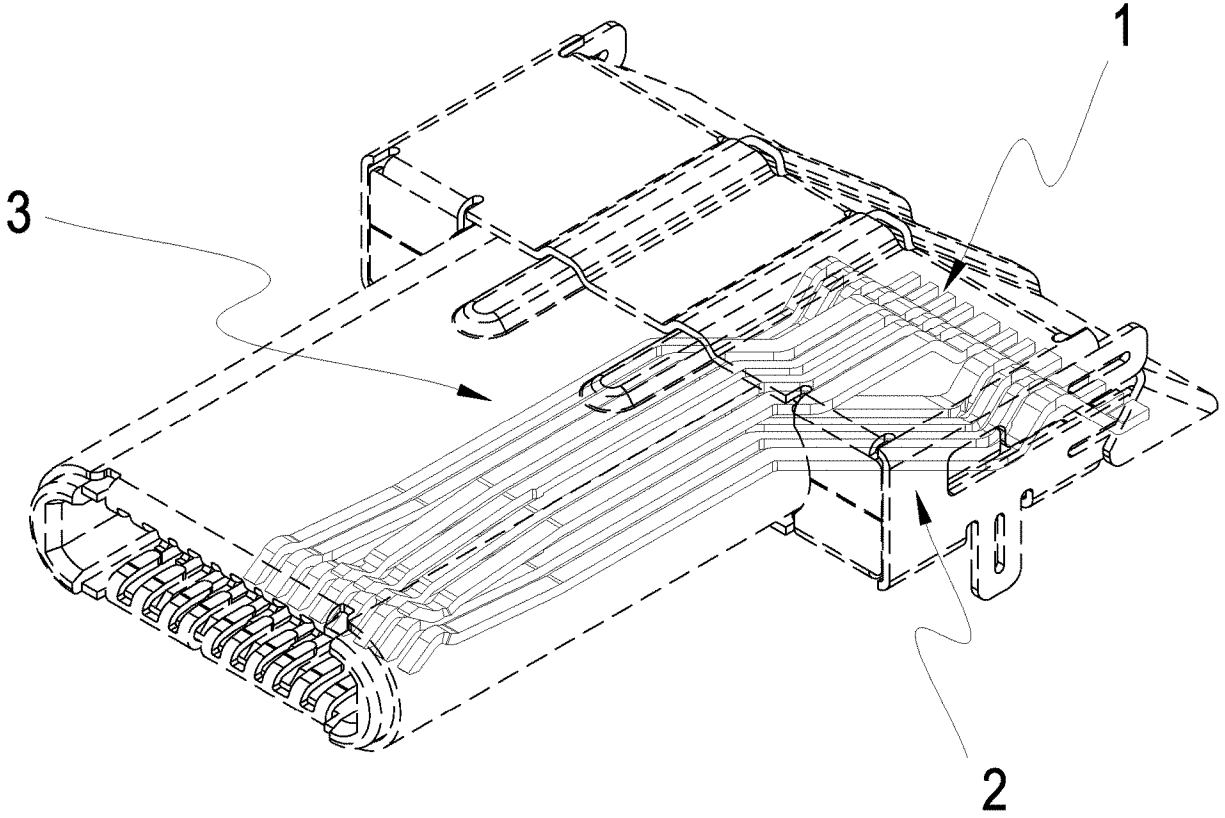
FIG. 1 is a perspective view, in a see-through form, illustrating a preferred embodiment of the present invention.
Figure 2:
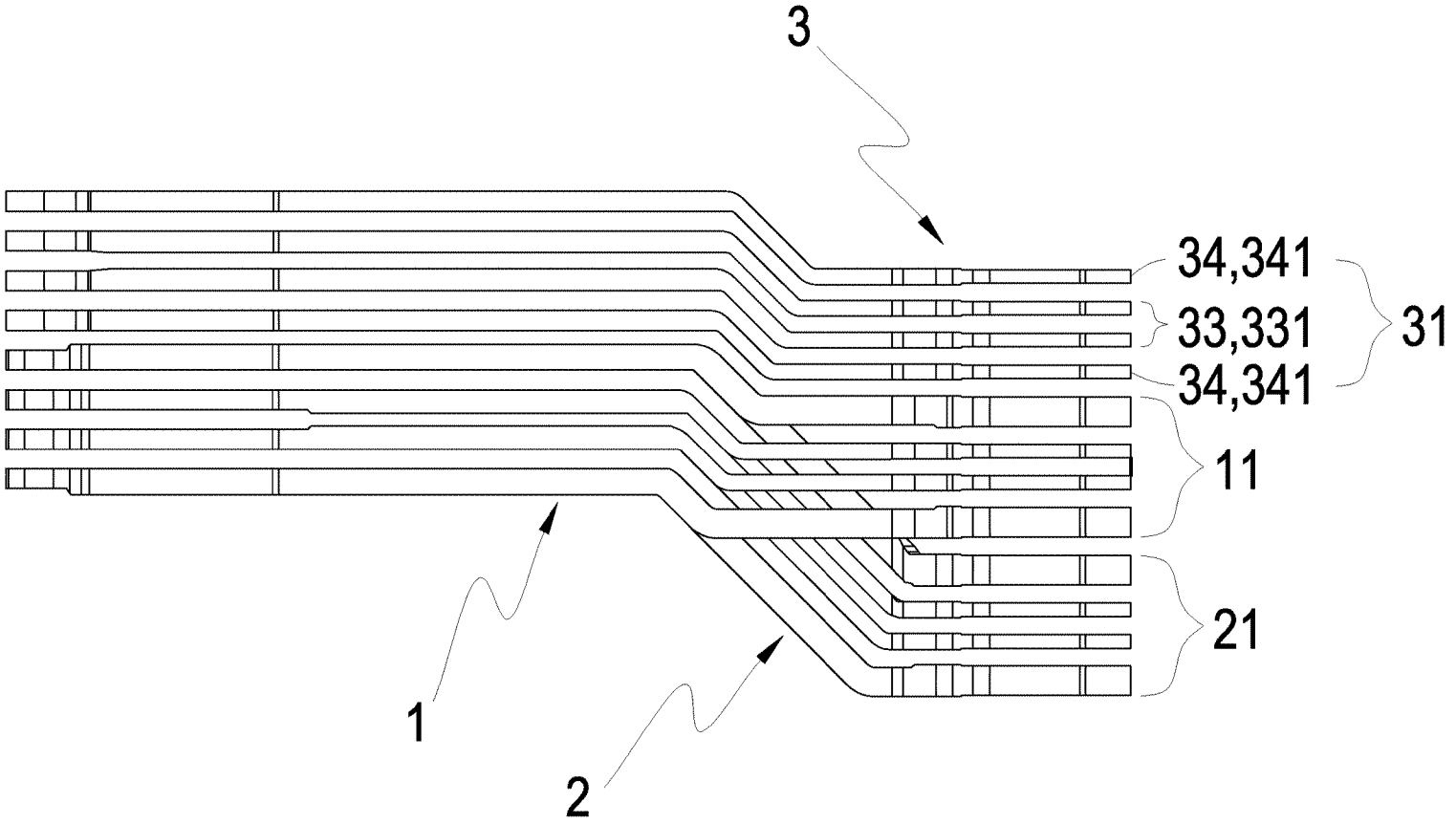
FIG. 2 is a plan view illustrating transmission conductors of the preferred embodiment.
Figure 3:
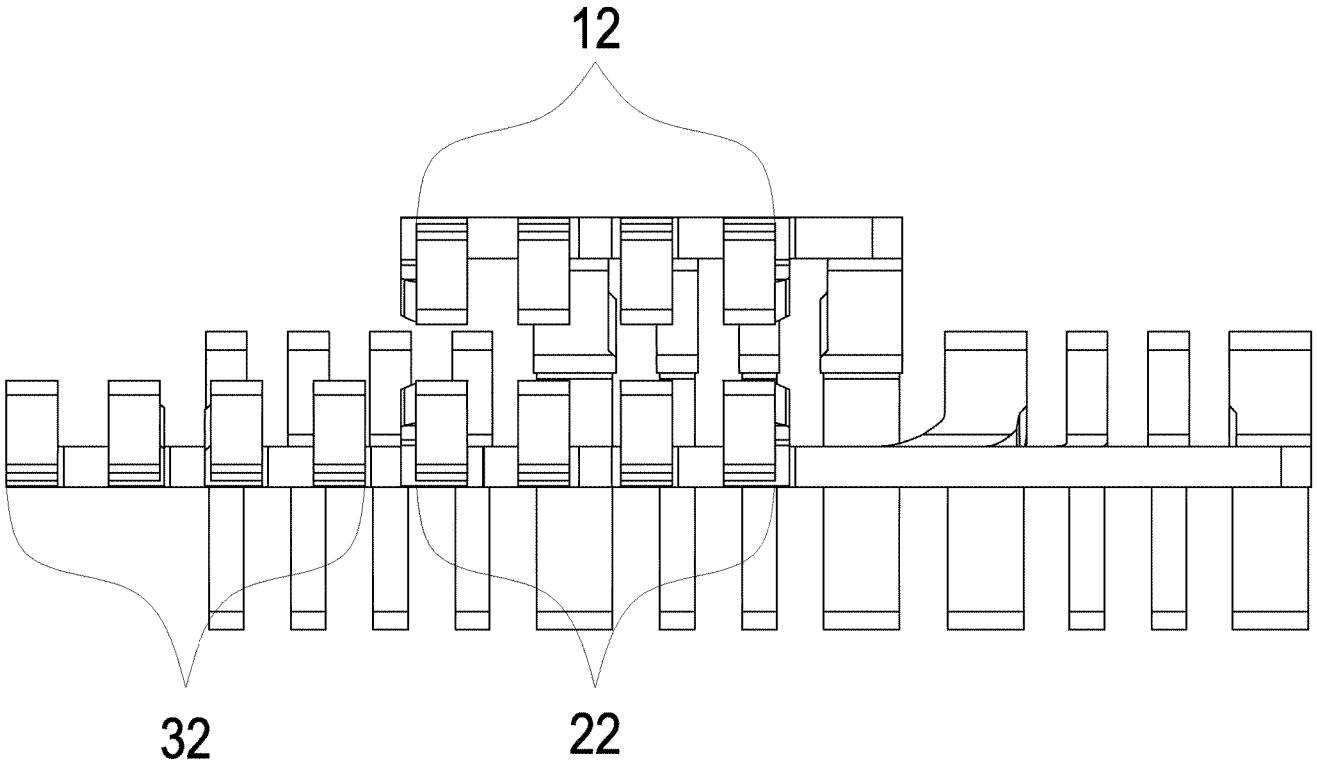
FIG. 3 is a front view illustrating the transmission conductors of the preferred embodiment.

Referring to FIGS. 1-3, which are respectively a perspective view, in a see-through form, illustrating a preferred embodiment of the present invention, is a plan view illustrating transmission conductors of the preferred embodiment, and a front view illustrating the transmission conductors of the preferred embodiment, it can be clearly seen from the drawings that the present invention is structured to have a transmission conductor group arranged according to functions and positions associated with electric characteristics. The transmission conductor group has a general structure that comprises:

a first signal transmission conductor group 1 that is provided for transmission of signals, the first signal transmission conductor group 1 having an end defining a first signal transmission adaptation section group 11 and an opposite end extended and defining a first signal mating section group 12 that is elastic or in a flat plate form;

a second signal transmission conductor group 2 that is arranged at one side of the first signal transmission conductor group 1 for transmission of signals, the second signal transmission conductor group 2 having one end defining a second signal transmission adaptation section group 21 that is located at one side of the first signal transmission adaptation section group 11 and an opposite end extended and defining a second signal mating section group 22 that is arranged opposite to the first signal mating section group 11 and is elastic or in a flat plate form;

at least one power transmission conductor group 3 that is arranged at one side of the first signal transmission conductor group 1 for transmission of power, the power transmission conductor group 3 having an end defining a power adaptation section group 31 that is located at one side of the first signal transmission adaptation section group 11 or the second signal transmission adaptation section group 21 and an opposite end extended and defining a power mating section group 32 that is arranged to have conductive members thereof opposite to each other and is elastic or in a flat plate form; further, the power transmission conductor group 3 further comprises two adjacent power differential signal transmission conductors 33 and power transmission conductors 34 respectively arranged at an outer side of each of the power differential signal transmission conductors 33 and the power transmission conductors 34 have a volume width that is greater than a volume width of the power differential signal transmission conductors 33.

Further, the first signal transmission adaptation section group 11 and the second signal transmission adaptation section group 21 that are described above have ends that extend in different directions and each of the power adaptation section group 31 has an end that similarly extends in a different direction.

Considering a spacing relationship, the power adaptation section group 31 is composed of power differential signal adaptation sections 331 that are respectively defined at ends of the power differential signal transmission conductors 33 and power adaptation sections 341 that are respectively defined at ends of the power transmission conductors 34 and a distance spacing the power differential signal adaptation sections 331 from each other is less than or substantially equal to a distance between the power differential signal adaptation sections 331 and the power adaptation sections 341.

Figure 4:
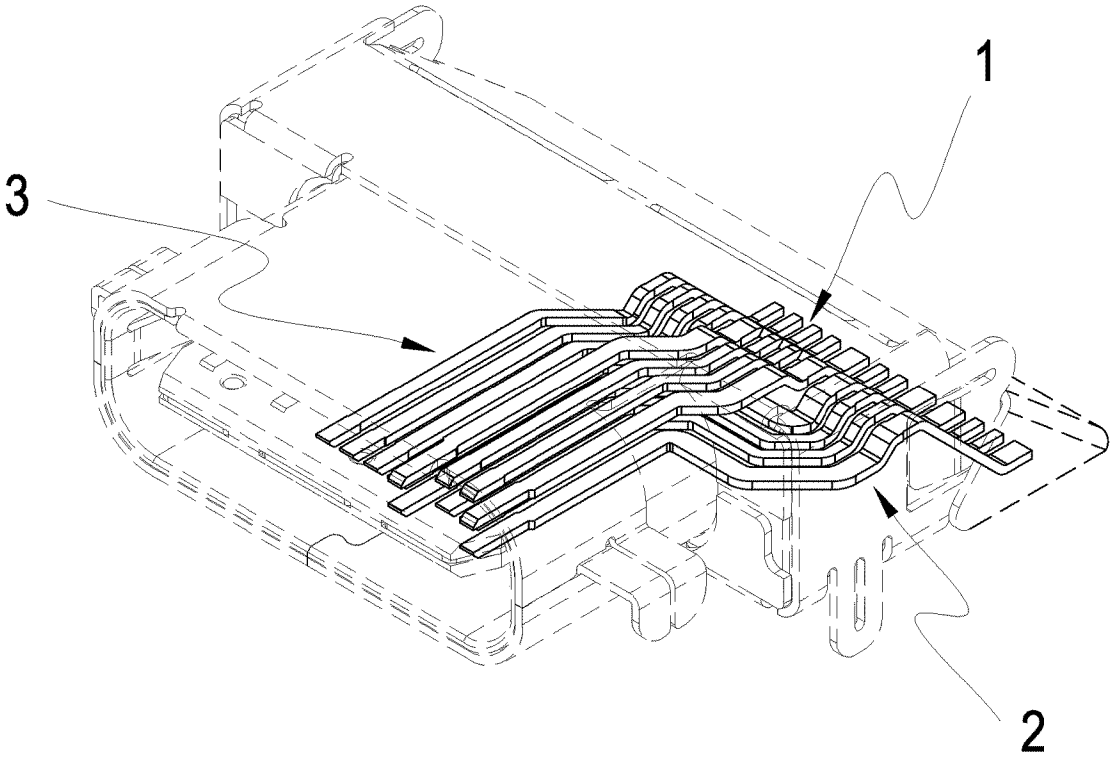
FIG. 4 is a schematic view illustrating a female socket connector according to the preferred embodiment.

The embodiment described above is a male part and apparently, the arrangement provided by the present invention is also applicable to a female part, as shown in FIG. 4, which illustrates a female socket connector according to the preferred embodiment of the present invention. In this way, the present invention is applicable, without constraint, to both a male part and a female connector and allows for plugging coupling with a male part.

Figure 5:
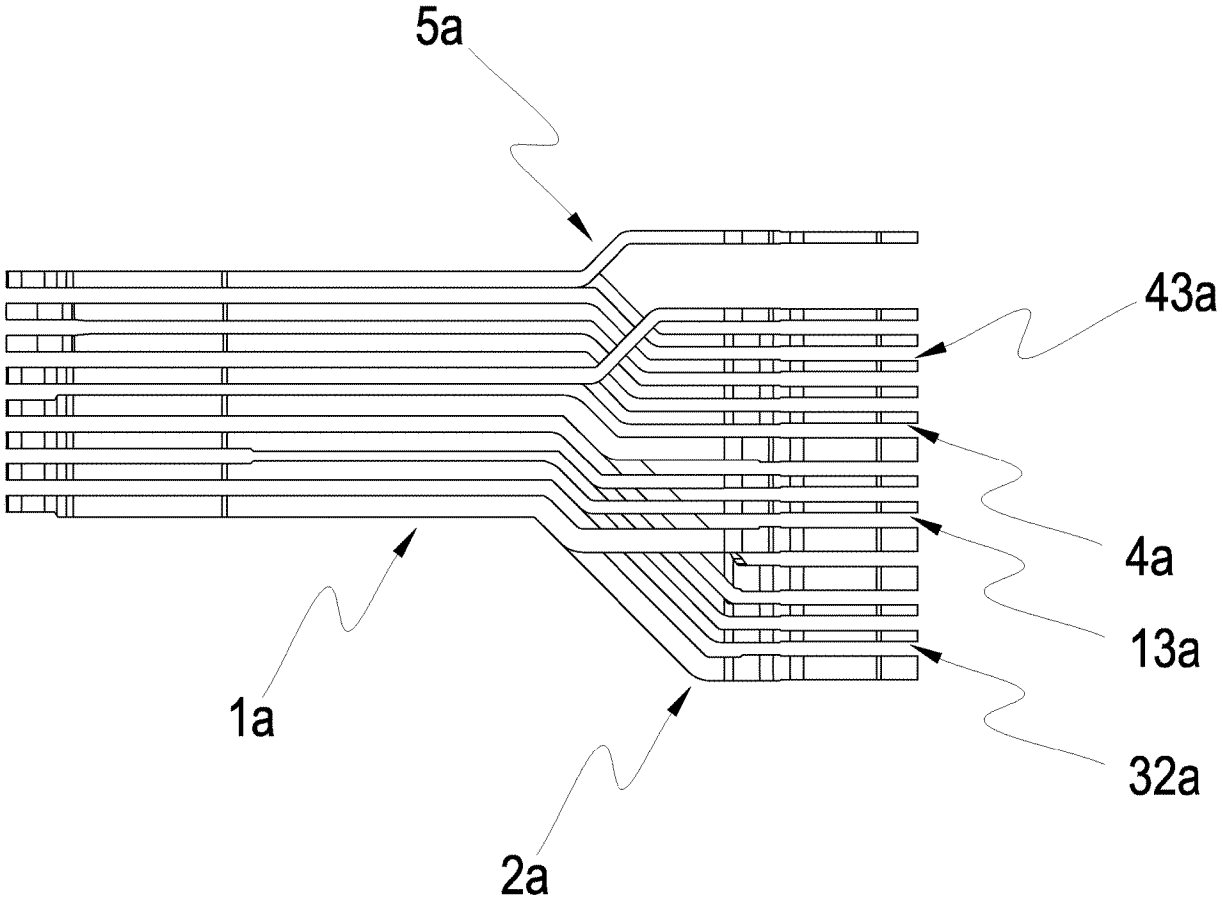
FIG. 5 is a plan view illustrating transmission conductors of another preferred embodiment of the present invention.
Figure 6:
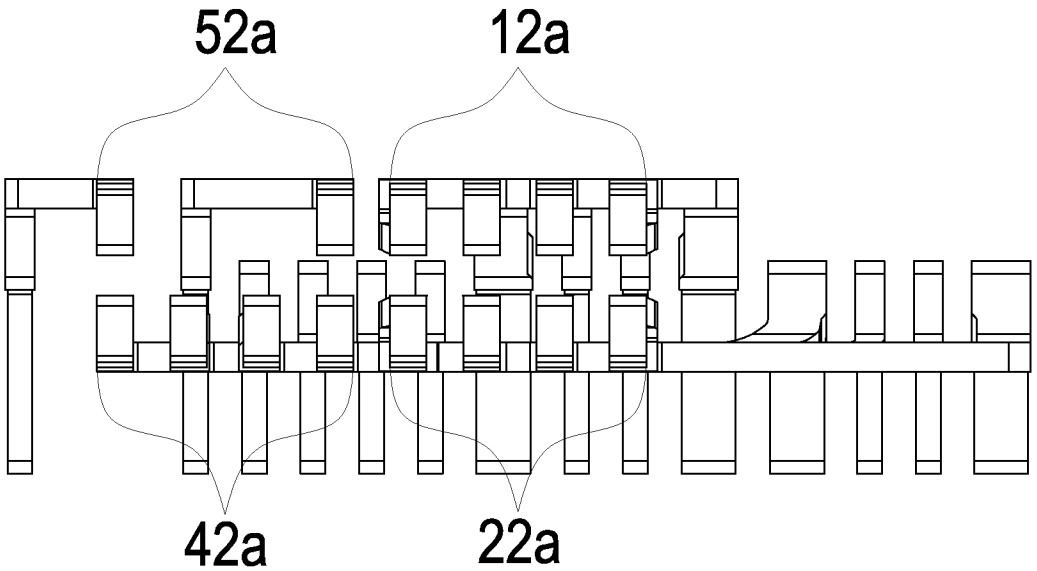
FIG. 6 is a front view illustrating the transmission conductors of said another preferred embodiment.

Referring to FIGS. 5 and 6, which are respectively a plan view illustrating transmission conductors of another preferred embodiment of the present invention and a front view illustrating the transmission conductors, it can be clearly seen from the drawings that a transmission conductor group is arranged according to functions and positions associated with electric characteristics. The transmission conductor group has a general structure that comprises:

a first signal transmission conductor group 1*a* that is provided for transmission of signals, the first signal transmission conductor group 1*a* having an end extended and defining a first signal mating section group 12*a;* a second signal transmission conductor group 2*a* that is arranged at one side of the first signal transmission conductor group 1*a* for transmission of signals, the second signal transmission conductor group 2*a* having one end extended and defining a second signal mating section group 22*a* that is arranged opposite to the first signal mating section group 12*a;* a first power transmission conductor group 4*a* that is arranged at one side of the first signal transmission conductor group 1*a* for transmission of power, the first power transmission conductor group 4*a* having an end extended and defining a first power mating section group 42*a*; and a second power transmission conductor group 5*a* that is arranged at a side of the first power transmission conductor group 4*a* that is distant from the first signal transmission conductor group 1*a* for transmission of power, the second power transmission conductor group 5*a* having an end extended and defining a second power mating section group 52*a* that is arranged opposite to the first power mating section group 42*a*.

Further, one of the first power transmission conductor group 4*a* and the second power transmission conductor group 5*a* comprises a plurality of power differential signal transmission conductors 43*a* and the first signal transmission conductor group 1*a* and the second signal transmission conductor group 2*a* respectively comprise a plurality of first differential signal transmission conductors 13*a* and a plurality of second differential signal transmission conductors 23*a*.

Figure 7:
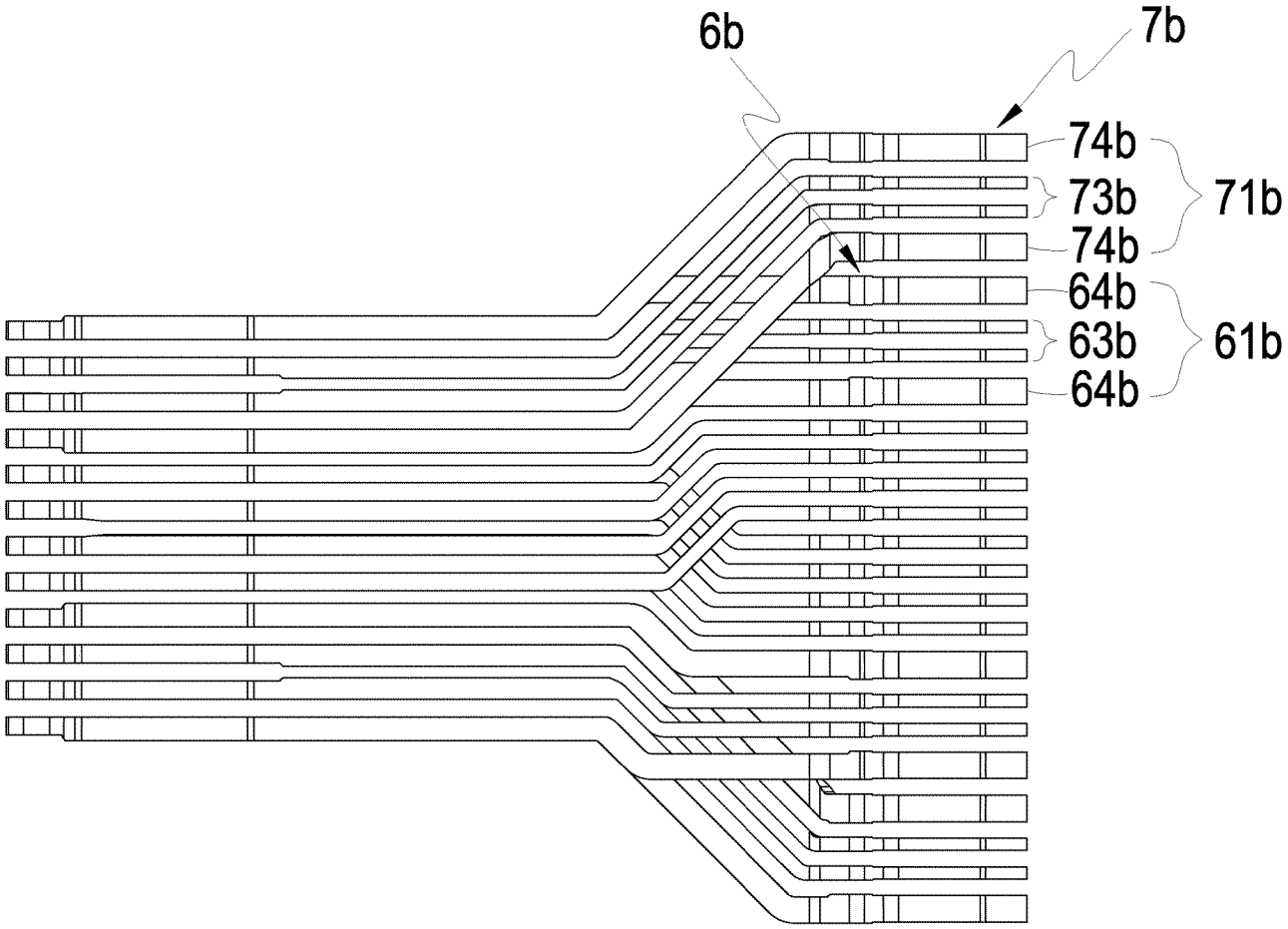
FIG. 7 is a plan view illustrating transmission conductors of a further preferred embodiment of the present invention.
Figure 8:
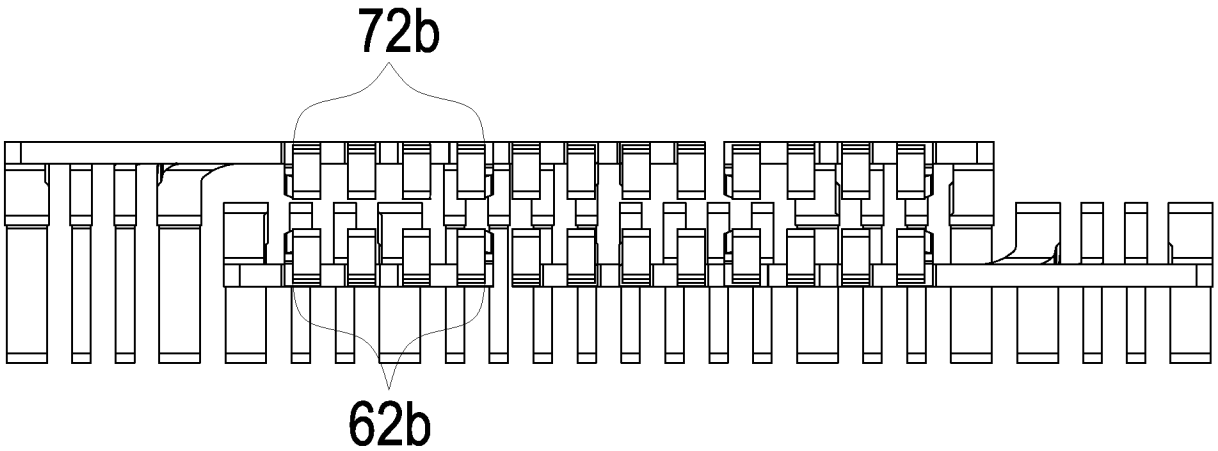
FIG. 8 is a front view illustrating the transmission conductors of said further preferred embodiment.

Referring to FIGS. 7 and 8, which are respectively a plan view illustrating transmission conductors of a further preferred embodiment of the present invention and a front view illustrating the transmission conductors, it can be clearly seen from the drawings that the instant embodiment is similar to said another embodiment discussed previously and a difference is that a third power transmission conductor group 6*b* and a fourth power transmission conductor group 7*b* are additionally included, wherein the third power transmission conductor group 6*b* is arranged at one side of the second signal transmission conductor group and the fourth power transmission conductor group 7*b* is arranged at one side of the third power transmission conductor group 6*b* that is distant from the second signal transmission conductor group; further, the third power transmission conductor group 6*b* has an end defining a third power adaptation section group 61*b* that is located at a side of the second signal transmission adaptation section group that is distant from the first signal transmission adaptation section group and the fourth power transmission conductor group 7*b* has an end defining a fourth power adaptation section group 71*b* that is located at a side of the third power adaptation section group 61*b* that is distant from the second signal transmission adaptation section group.

The third power transmission conductor group 6*b* has an end extended and defining a third power mating section group 62*b* and the fourth power transmission conductor group 7*b* has an end extended and defining a fourth power mating section group 72*b* that is arranged opposite to the third power mating section group 62*b*.

The first signal mating section group, the second signal mating section group, the first power mating section group, the second power mating section group, the third power mating section group 62*b*, and the fourth power mating section group 72*b* are each elastic or in a flat plate form.

The first power transmission conductor group, the second power transmission conductor group, the third power transmission conductor group 6*b*, and the fourth power transmission conductor group 7*b* respectively comprise two adjacent power differential signal transmission conductors 63*b*, 73*b* and power transmission conductors 64*b*, 74*b* respectively arranged at an outer side of each of the power differential signal transmission conductors 63*b*, 73*b* and the power transmission conductors 64*b*, 74*b* have a volume width that is greater than a volume width of the power differential signal transmission conductors 63*b*, 73*b*.

The third power adaptation section group 61*b* and the fourth power adaptation section group 71*b* have ends extending in different directions.

More importantly, the first power transmission conductor group, the second power transmission conductor group, the third power transmission conductor group 6*b*, and the fourth power transmission conductor group 7*b* respectively comprise two adjacent power differential signal transmission conductors 63*b*, 73*b* and power transmission conductors 64*b*, 74*b* respectively arranged at an outer side of each of the power differential signal transmission conductors 63*b*, 73*b* and the third and fourth power adaptation section groups 61*b*, 71*b* are composed of power differential signal adaptation sections defined at ends of the power differential signal transmission conductors and power adaptation sections defined at ends of the power transmission conductors and a distance spacing the power differential signal adaptation sections from each other is less than or substantially equal to a distance spacing the power differential signal adaptation sections and the power adaptation sections.

Figure 9:
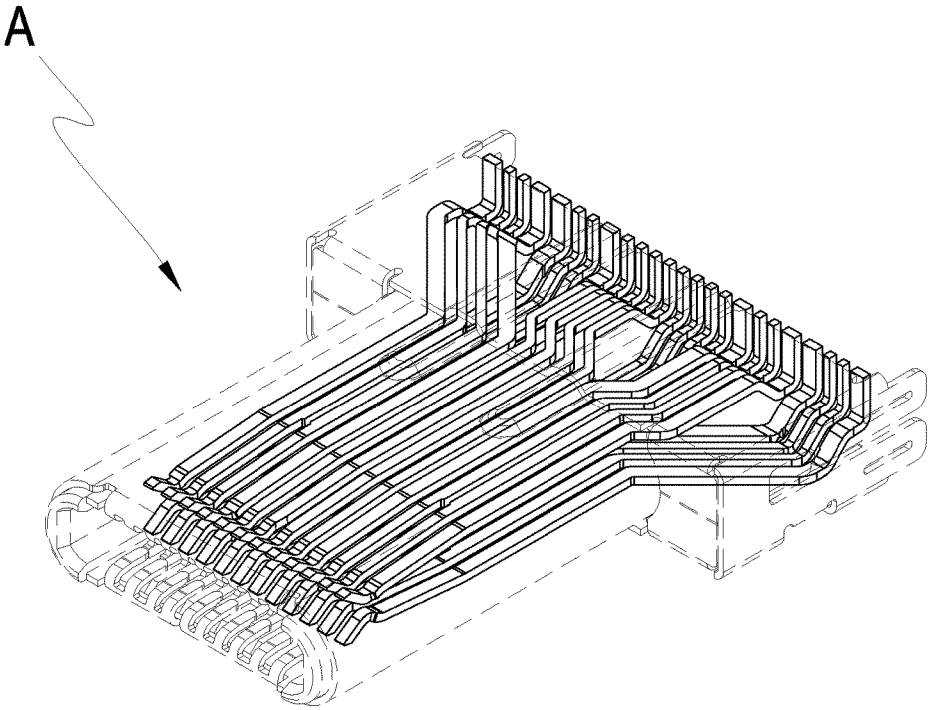
FIG. 9 is a schematic view illustrating a vertical male plug connector according to yet a further preferred embodiment of the present invention.

Referring to FIG. 9, which is a schematic view illustrating a vertical male plug connector according to yet a further preferred embodiment of the present invention, it is clearly seen from the drawing that, besides being in a flat plate form, the present invention can be structured as a vertical connector A that is illustrated in this embodiment, where the internal transmission conductor group is arranged and structured in a way similar to the previous embodiment so that repeated description will be omitted.

Figure 10:
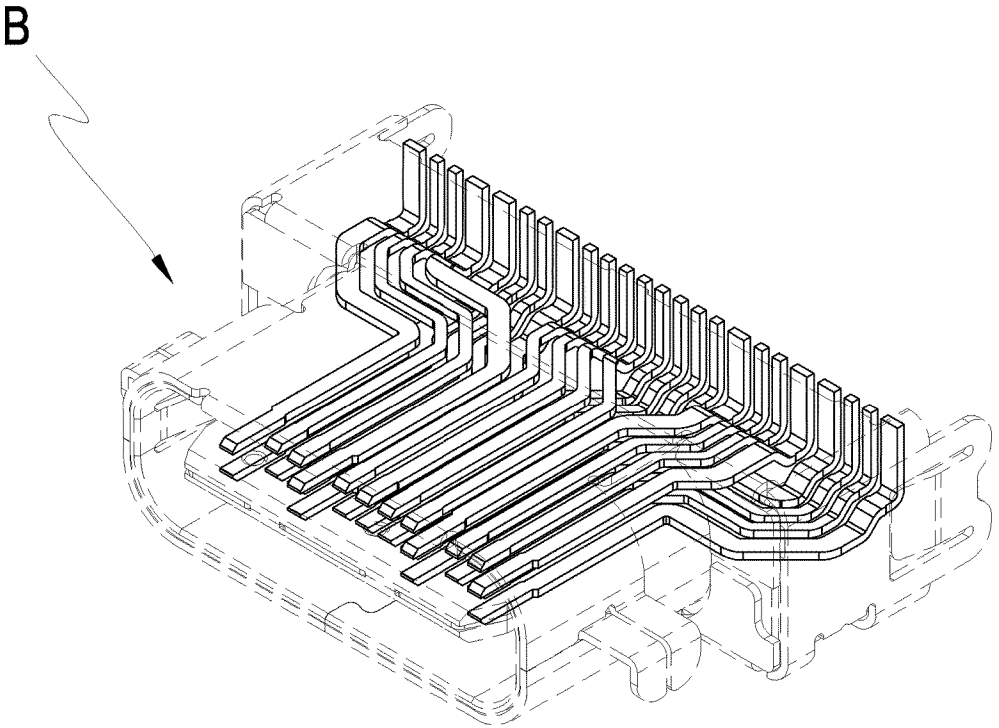
FIG. 10 is a schematic view illustrating a vertical female socket connector according to yet a further preferred embodiment of the present invention.

Referring to FIG. 10, which is a schematic view illustrating a vertical female socket connector according to yet a further preferred embodiment of the present invention, it is clearly seen from the drawings that, besides being in a flat form of female socket, the present invention can be structured as a vertical female socket connector B that is illustrated in this embodiment, where the internal transmission conductor group is arranged and structured in a way similar to the previous embodiment so that repeated description will be omitted.

Based on the above embodiments, the present invention provides an advantage of increasing self-inductance of the active signal pair and reducing mutual induction of reference signals at opposite sides so as to reduce common mode effect and eliminate radio frequency interference of a wireless device caused by high frequency electromagnetic radiation noises, which is commonly referred to as radio frequency hijacking.

The present invention increases the width of positive and negative power side conductors to increase the cross-sectional areas to for example increase the electrical current to thereby alleviate the problems that electric resistance may be increased due to insufficiency of cross-sectional area of conductor and thus help improve the issues regarding rise of operation temperature and deterioration of operation voltage of a power supply.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A USB Type-C connector, which comprises a transmission conductor group arranged according to functions and positions associated with electric characteristics, the transmission conductor group comprising:

a first signal transmission conductor group for transmission of signals;

a second signal transmission conductor group that is arranged at one side of the first signal transmission conductor group for transmission of signals; and at least one power transmission conductor group that is arranged at one side of the first signal transmission conductor group for transmission of power;

wherein the first signal transmission conductor group has an end defining a first signal transmission adaptation section group, the second signal transmission conductor group having an end defining second signal transmission adaptation section group that is located at one side of the first signal transmission adaptation section group, the power transmission conductor group having an end defining a power adaptation section group that is located at one side of the first signal transmission adaptation section group or the second signal transmission adaptation section group; the first signal transmission conductor group has an end extended and defining a first signal mating section group, the second signal transmission conductor group having an end extended and defining second signal mating section group arranged opposite to the first signal mating section group, the power transmission conductor group having an end extended and defining a power mating section group having conductive members opposite to each other.

2. The USB Type-C connector according to claim 1, wherein the first signal mating section group, the second signal mating section group, and the power mating section group are elastic.

3. The USB Type-C connector according to claim 1, wherein the first signal mating section group, the second signal mating section group and the power mating section group are each in a flat plate form.

4. The USB Type-C connector according to claim 1, wherein the power transmission conductor group comprises two adjacent power differential signal transmission conductors and power transmission conductors respectively arranged at an outer side of each of the power differential signal transmission conductors, the power transmission conductors having a volume width that is greater than a volume width of the power differential signal transmission conductors.

5. The USB Type-C connector according to claim 4, wherein the first signal transmission adaptation section group and the second signal transmission adaptation section group have ends that extend in different directions and each of the power adaptation section group has an end that similarly extends in a different direction.

6. The USB Type-C connector according to claim 1, wherein the power transmission conductor group comprises two adjacent power differential signal transmission conductors and power transmission conductors respectively arranged at an outer side of each of the power differential signal transmission conductors, the power adaptation section group comprising power differential signal adaptation sections respectively defined at ends of the power differential signal transmission conductors and power adaptation sections respectively defined at ends of the power transmission conductors, a distance spacing the power differential signal adaptation sections from each other being less than or substantially equal to a distance spacing the power differential signal adaptation sections and the power adaptation sections.

7. A USB Type-C connector, which comprises a transmission conductor group arranged according to functions and positions associated with electric characteristics, the transmission conductor group comprising:

a first signal transmission conductor group for transmission of signals;

a second signal transmission conductor group that is arranged at one side of the first signal transmission conductor group for transmission of signals;

a first power transmission conductor group that is arranged at one side of the first signal transmission conductor group for transmission of power; and a second power transmission conductor group that is arranged at a side of the first power transmission conductor group that is distant from the first signal transmission conductor group for transmission of power;

wherein one of the first power transmission conductor group and the second power transmission conductor group comprises a plurality of power differential signal transmission conductors and the first signal transmission conductor group and the second signal transmission conductor group respectively comprise a plurality of first differential signal transmission conductors and a plurality of second differential signal transmission conductors.

8. The USB Type-C connector according to claim 7, wherein the first signal transmission conductor group has an end extended and defining a first signal mating section group, the second signal transmission conductor group having an end extended and defining a second signal mating section group that is arranged opposite to the first signal mating section group, the first power transmission conductor group having an end extended and defining a first power mating section group, the second power transmission conductor group having an end extended and defining a second power mating section group that is arranged opposite to the first power mating section group.

9. The USB Type-C connector according to claim 7, wherein the first signal transmission conductor group has an end extended and defining a first signal mating section group, the second signal transmission conductor group having an end extended and defining a second signal mating section group that is arranged opposite to the first signal mating section group, the first power transmission conductor group having an end extended and defining a first power mating section group, the second power transmission conductor group having an end extended and defining a second power mating section group that is arranged opposite to the first power mating section group.

10. A USB Type-C connector, which comprises a transmission conductor group arranged according to functions and positions associated with electric characteristics, the transmission conductor group comprising:

a first signal transmission conductor group for transmission of signals;

a second signal transmission conductor group that is arranged at one side of the first signal transmission conductor group for transmission of signals;

a first power transmission conductor group that is arranged at one side of the first signal transmission conductor group for transmission of power;

a second power transmission conductor group that is arranged at a side of the first power transmission conductor group that is distant from the first signal transmission conductor group for transmission of power;

a third power transmission conductor group that is arranged at one side of the second signal transmission conductor group for transmission of power; and a fourth power transmission conductor group that is arranged at a side of the third power transmission conductor group that is distant from the second signal transmission conductor group for transmission of power.

11. The USB Type-C connector according to claim 10, wherein the first signal transmission conductor group has an end defining a first signal transmission adaptation section group, the second signal transmission conductor group having an end defining a second signal transmission adaptation section group that is located at one side of the first signal transmission adaptation section group, the first power transmission conductor group having an end defining a first power adaptation section group at a side of the first signal transmission adaptation section group that is distant from the second signal transmission adaptation section group, the second power transmission conductor group having an end defining a second power adaptation section group at a side of the first power adaptation section group that is distant from the first signal transmission adaptation section group, the third power transmission conductor group having an end defining a third power adaptation section group at a side of the second signal transmission adaptation section group that is distant from the first signal transmission adaptation section group, the fourth power transmission conductor group having an end defining a fourth power adaptation section group at a side of the third power adaptation section group that is distant from the second signal transmission adaptation section group.

12. The USB Type-C connector according to claim 11, wherein the first signal transmission conductor group having an end extended and defining a first signal mating section group, the second signal transmission conductor group having an end extended and defining a second signal mating section group that is arranged opposite to the first signal mating section group, the first power transmission conductor group having an end extended and defining a first power mating section group, the second power transmission conductor group having an end extended and defining a second power mating section group that is arranged opposite to the first power mating section group, the third power transmission conductor group having an end extended and defining a third power mating section group, the fourth power transmission conductor group having an end extended and defining a fourth power mating section group that is arranged opposite to the third power mating section group.

13. The USB Type-C connector according to claim 12, wherein the first signal mating section group, the second signal mating section group, the first power mating section group, the second power mating section group, the third power mating section group, and the fourth power mating section group are each elastic.

14. The USB Type-C connector according to claim 12, wherein the first signal mating section group, the second signal mating section group, the first power mating section group, the second power mating section group, the third power mating section group, and the fourth power mating section group are each in a flat plate form.

15. The USB Type-C connector according to claim 11, wherein the first power transmission conductor group, the second power transmission conductor group, the third power transmission conductor group and the fourth power transmission conductor group comprise two adjacent power differential signal transmission conductors and power transmission conductors respectively arranged at an outer side of each of the power differential signal transmission conductors, the power transmission conductors having a volume width that is greater than a volume width of the power differential signal transmission conductors.

16. The USB Type-C connector according to claim 15, wherein the first signal transmission adaptation section group and the second signal transmission adaptation section group have ends that extend in different directions, the first power adaptation section group and the second power adaptation section group having ends that extend in different directions, the third power adaptation section group and the fourth power adaptation section group having ends that extend in different directions.

17. The USB Type-C connector according to claim 11, wherein the first power transmission conductor group, the second power transmission conductor group, the third power transmission conductor group, and the fourth power transmission conductor group comprise two adjacent power differential signal transmission conductors and power transmission conductors respectively arranged at an outer side of each of the power differential signal transmission conductors, the power adaptation section group comprising power differential signal adaptation sections defined at ends of the power differential signal transmission conductors and power adaptation sections defined at ends of the power transmission conductors, a distance spacing the power differential signal adaptation sections being less than or substantially equal to a distance spacing the power differential signal adaptation sections and the power adaptation sections.

* * * * *